US005666589A

United States Patent [19]

Yoshinaga et al.

[11] Patent Number: 5,666,589

[45] Date of Patent: Sep. 9, 1997

[54] ELECTROPHOTOGRAPHIC APPARATUS AND IMAGE FORMING METHOD USING A PHOTOSENSITIVE MEMBER WITH EXPOSURE CHARACTERISTICS RESPONSIVE TO FIELD INTENSITY

[75] Inventors: Kazuo Yoshinaga, Kawasaki; Yukio Nagase, Tokyo; Hajime Miyazaki; Teigo Sakakibara, both of Yokohama; Yuichi Hashimoto, Tokyo; Yoshio Kashizaki, Yokohama; Masato Tanaka, Kawasaki; Mamoru Tanaka, Yokohama, all of Japan

[73] Assignee: Canon Kabushiki Kaisha, Tokyo, Japan

[21] Appl. No.: 497,420

[22] Filed: Jun. 30, 1995

[30] Foreign Application Priority Data

Jun. 30, 1994 [JP] Japan ..... 6-148837

[51] Int. Cl.[6] ..... G03G 15/00

[52] U.S. Cl. ..... 399/48; 358/296

[58] Field of Search ..... 355/200, 210, 355/203, 204, 208, 214, 219, 228, 233; 358/296, 300, 448, 455, 458, 461; 347/224; 399/38, 48, 50

[56] References Cited

U.S. PATENT DOCUMENTS

| | | | |
|---|---|---|---|
| 4,761,359 | 8/1988 | Sakai et al. | 430/126 |
| 4,882,257 | 11/1989 | Maruyama et al. | 430/100 |
| 4,963,452 | 10/1990 | Kinoshita | 430/78 |
| 5,181,071 | 1/1993 | Nakajima et al. | 355/203 |
| 5,241,347 | 8/1993 | Kodama | 355/246 |
| 5,325,122 | 6/1994 | Hattori et al. | 346/160 |
| 5,363,174 | 11/1994 | Magde, Jr. et al. | 355/208 |
| 5,459,555 | 10/1995 | Yamasa et al. | 355/208 |
| 5,469,243 | 11/1995 | Saitoh et al. | 355/208 X |
| 5,499,079 | 3/1996 | Kinoshita et al. | 355/208 |

FOREIGN PATENT DOCUMENTS

| | | |
|---|---|---|
| 0589131 | 3/1994 | European Pat. Off. . |
| 4126457 | 2/1992 | Germany . |
| 1-169454 | 7/1989 | Japan . |

*Primary Examiner*—Sandra L. Brase

*Attorney, Agent, or Firm*—Fitzpatrick, Cella, Harper & Scinto

[57] ABSTRACT

An electrophotographic system is constituted by an electrophotographic photosensitive member, a charger for charging the photosensitive member to a potential, and an illuminator for illuminating the charged photosensitive member with a light beam to form an electrostatic image thereon. The electrophotographic photosensitive member has a potential-exposure energy characteristic providing an induction energy and a gamma valve varying depending on an electric field intensity induced by the charged potential. The electrophotographic system further includes a controller for controlling the charged potential on the photosensitive member corresponding to resolution and gradation data of an original, so as to optimally reproduce the resolution and gradation, as desired, of the original.

32 Claims, 7 Drawing Sheets

ELECTROPHOTOGRAPHIC APPARATUS AND IMAGE FORMING METHOD USING A PHOTOSENSITIVE MEMBER WITH EXPOSURE CHARACTERISTICS RESPONSIVE TO FIELD INTENSITY

FIELD OF THE INVENTION AND RELATED ART

The present invention relates to an electrophotographic apparatus and an image forming method using a specific electrophotographic photosensitive member under a specific process condition.

Known image forming apparatus include the laser beam printer and the LED printer, which use electrophotography and are know as high-speed and low-noise printers. They are generally used for binary recording of forming images, such as characters and figures, depending on whether or not a particular portion of photosensitive member is irradiated with a laser beam or light from a light-emitting diode. Generally, a printer for reproducing characters or figures and not required to reproduce halftones can be formed in a simple structure, but a printer based on a binary recording scheme still can exhibit halftones.

Well-known examples of such printers may include those utilizing the dither method and the density pattern method. However, as is well known, it is difficult for such a printer based on the dither method or the density pattern method to provide a high resolution.

On the other hand, in recent years, the PWM (pulse width modulation) scheme has been proposed as a scheme for forming a halftone at each pixel while retaining a high resolution and without lowering the recording density. According to this scheme, the laser beam irradiation time is modulated based on image signals to form halftone pixels, whereby high-resolution and gradation-rich images can be formed. This scheme is particularly suitable for a color image forming apparatus requiring a high resolution and a high gradation characteristic in combination. More specifically, according to the PWM scheme, an areal gradation image can be formed with a dot formed by a beam spot for each pixel, so that a halftone can be exhibited without lowering the resolution.

Even in the PWM scheme, however, if the image density is further increased, the pixel size is decreased relative to the exposure dot diameter, so that it is liable to be difficult to realize sufficient gradation levels. On the other hand, order to provide a higher resolution while retaining the gradation characteristic, it is necessary to provide a smaller exposure spot diameter. In order to accomplish this in a scanning optical system, for example, it becomes necessary to use a laser beam having a shorter wavelength or an f-θ lens having a larger NA (numerical aperture). According to these measures, however, it becomes necessary to use an expensive laser, lens and large-sized scanner. This would also require an increased mechanical accuracy corresponding to a lowering in focal depth, thus inevitably resulting in an increase in apparatus size and an increase in production cost. Further, even using a solid state scanner, such as an LED array or a liquid crystal shutter array, it is difficult to avoid an increase in cost of the scanner, a required increase in affixing accuracy and an increase in cost of electrical drive circuit.

In spite of existing problems as described above, an image forming apparatus using the electrophotographic scheme has been required to exhibit even higher resolution and gradation characteristic in recent years.

On the other hand, an electrophotographic photosensitive member has been found that posseses a potential (V)-exposure energy (E) characteristic such that it shows a low sensitivity at a low exposure energy and a higher sensitivity at an increasing exposure energy, i.e., a photosensitive member having an induction energy (JP-A 1-169454). According to our study, if such a photosensitive member is illuminated with a spot beam having an intensity distribution therein, it has been found possible to reduce the illumination spot diameter by removing the effect of the low exposure energy portion. As a result, by using an image forming apparatus wherein such a photosensitive member is scanned with an illumination spot beam having an intensity distribution, it has become possible to stably obtain a resolution which is higher than expected by the illumination spot diameter. However, the photosensitive member has a very large gamma valve (γ) on the sensitivity curve and is very sensitive to a fluctuation in exposure quantity or to mechanical fluctuation. Thus this type of photosensitve member is not fully suited for reproduction of gradation images. As a result of further study, we have found that such a photosensitive member may be provided with an induction energy (an exposure energy corresponding to a low-sensitivity region of the photosensitive member) depending on an electric field intensity caused by a surface potential given to the photosensitive member. Further, the photosensitive member can be provided with a γ which varies depending on the electric field intensity. The present invention has been accomplished based on these findings.

The value of γ used herein may be determined for each V (surface potential)-E (Exposure energy) curve as shown in FIGS. 1 and 2 and is defined as a ratio of a slope (V-VR)/(Eo-Eind) of an approximately linearized high-sensitivity region to a slope (V-VR)/Eo representing an overall sensitivity, i.e., a ratio Eo/(Eo-Eind), wherein V denotes a maximum (initially charged) potential, VR denotes a residual potential (at Eo), Eo denotes a saturation exposure energy or saturation sensitivity (FIG. 2), and Eind denotes an induction energy defined as an exposure energy at an intersection of the approximately linearized curved of high-sensitivity region and the initial potential level V. For example, in the case of V (initial potential)=500 volts in FIG. 1, the γ value is calculated as Eo/(Eo-Eind)=1.4/(1.4−0.9)=2.8. Similarly, in case of V=300 volts, γ=1.2/(1.2−0.6)=2.0. In case of V=200 volts, γ=1.0/(1.0−0.36)≈1.6. In contrast thereto, in the case of an ordinary photosensitive member having a V-E curve (as shown in FIG. 7) which is downwardly convex and has substantially no induction energy, γ(=Eo/(Eo-Eind)) is always 1.

SUMMARY OF THE INVENTION

Based on the above findings, an object of the present invention is to provide an electrophotographic system (apparatus and method) capable of optimally reproducing or/and modifying the resolution and gradation of an original.

According to the present invention, there is provided an electrophotographic apparatus, comprising: an electrophotographic photosensitive member, charging means for charging the photosensitive member to a potential, and an exposure means for illuminating the charged photosensitive member with a light beam to form an electrostatic image thereon; wherein said electrophotographic photosensitive member has a potential-exposure energy characteristic providing an induction energy and a γ which varies depending on an electric field intensity induced by the charged potential, and said apparatus further includes a control means for controlling the charged potential on the photosensitive member corresponding to resolution and gradation data of an original.

According to the present invention, there is also provided an image forming method, comprising: a charging step of charging an electrophotographic photosensitive member to a charged potential, and an exposure step of illuminating the charged photosensitive member with a light beam to form an electrostatic image thereon; wherein said electrophotographic photosensitive member has a potential-exposure energy characteristic providing an induction energy and a γ which varies depending on an electric field intensity induced by the charged potential, and in the charging step, the charged potential on the photosensitive member is controlled corresponding to resolution and gradation data of an original.

These and other objects, features and advantages of the present invention will become more apparent upon a consideration of the following description of the preferred embodiments of the present invention taken in conjunction with the accompanying drawings.

DETAILED DESCRIPTION OF THE INVENTION

The electrophotographic photosensitive member used in the electrophotographic system (apparatus and method) of the present invention possessers V (surface potential)-E (exposure energy) characteristics providing an induction energy and γ which varies depending on an electric field intensity induced by the charged potential on the photosensitive member. The charged potential on the photosensitive member given by the charging means is controlled based on resolution and gradation data of given original.

Figure 1:
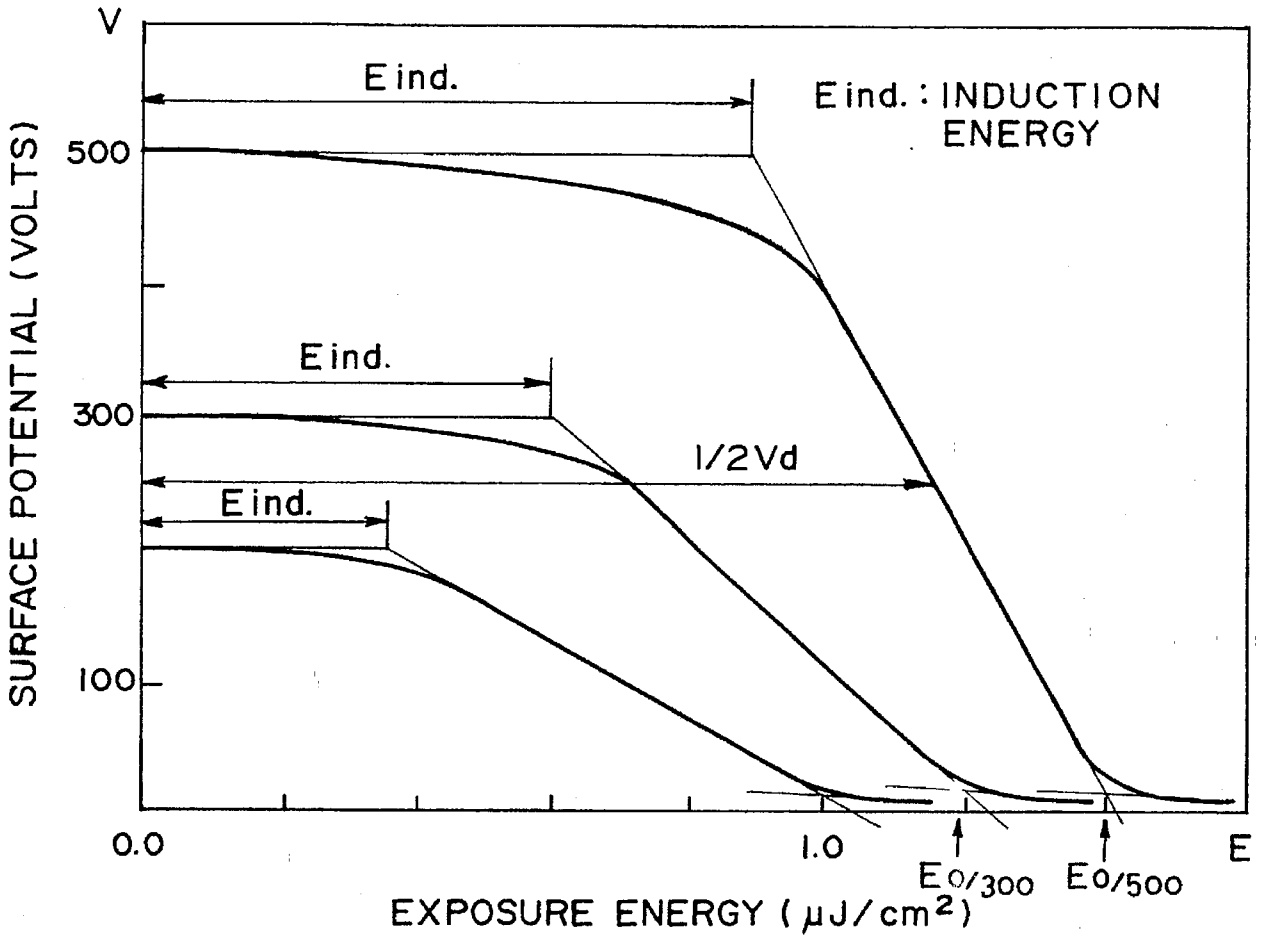
FIG. 1 is a graph showing V (surface potential)-E (exposure energy) curves of an electrophotographic photosensitive member used in the invention.
Figure 2:
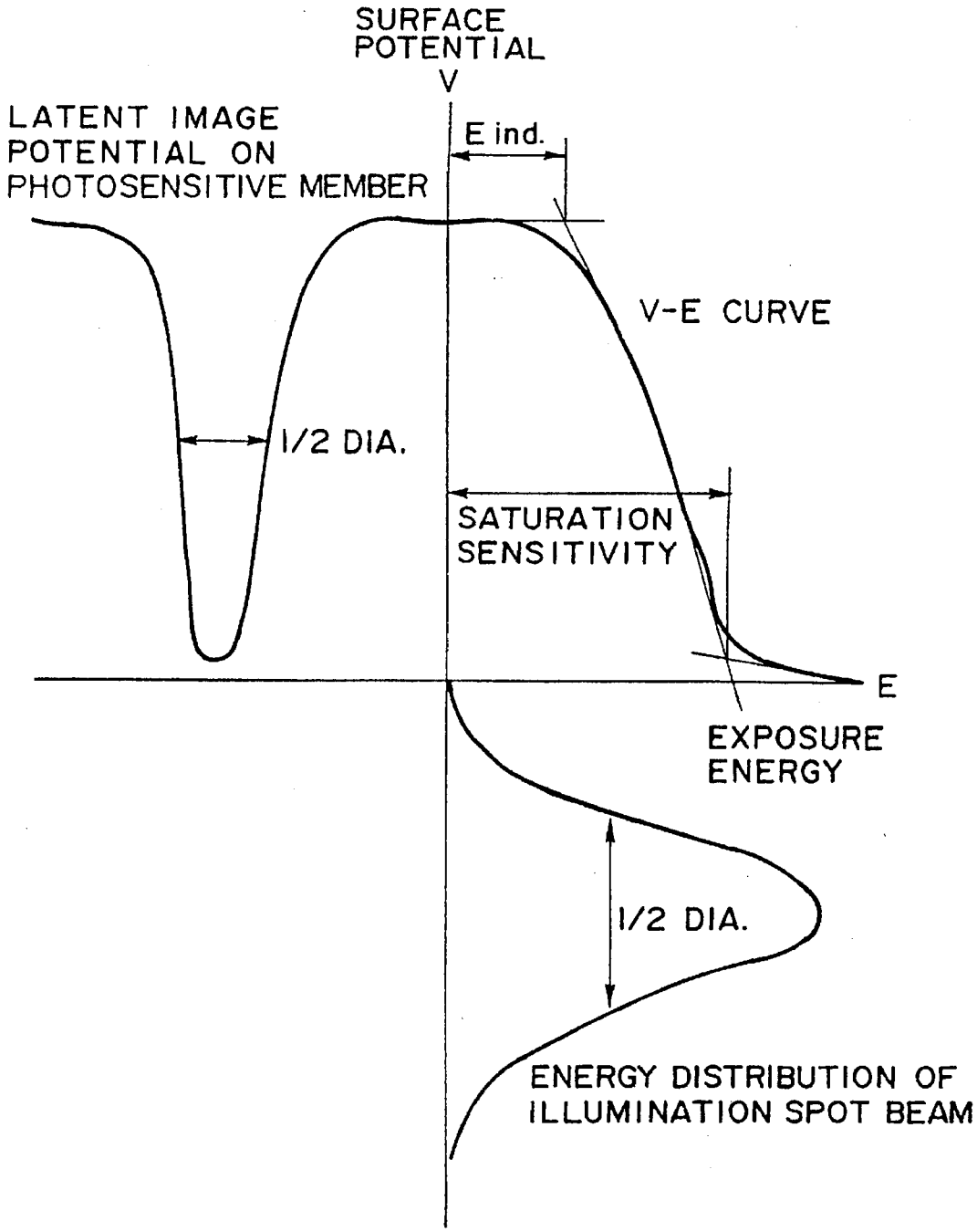
FIG. 2 is a graph for illustrating a relationship between an exposure energy distribution and a resultant electrostatic (latent) image potential distribution on a photosensitive member used in the invention.

FIG. 1 shows three V-E curves of an electrophotographic photosensitive member used in the present invention having an induction energy and a γ which varies depending on the charged potential levels. These V-E curves are shown corresponding to initial potential levels of 500 volts, 300 volts and 200 volts, respectively. For each V-E curve, the induction energy Eind may be defined as an exposure energy at an extrapolation of a linearly attenuating portion of the V-E curve with the charged potential level. The definition of the γ value has been already described above. An indication of sensitivity is given by a half-attenuation exposure energy (½×Vd), by application of which the initially charged potential is attenuated to a half thereof. Both the induction energy Eind and the value ½×Vd increase as the electric field intensity (in terms of an absolute value) increases, but the ½×Vd value increases in a smaller rate than the induction energy Eind, whereby the γ value increases as the charged potential (in terms of an absolute value) increases. Accordingly, at a constant exposure intensity (energy), it is possible to increase the resolution of a latent image formed on the photosensitive member by illumination with a spot beam as illustrated in FIG. 2. However, in order to also effect a recording with a certain level of good gradation characteristic, the electric field intensity (absolute value) may preferably be at most 50 volts/ μm, more preferably at most 40 volts/μm. On the other hand, an electric field intensity of below 10 volts/μm is liable to decrease the induction energy to a non-effective level, thereby being liable to fail in providing an improved resolution. An electric field intensity in the range of 15–38 volts/μm may be further desirably used.

Herein, the electric field intensity for a photosensitive member may be determined by dividing a surface potential (volts) on the photosensitive member with a total thickness (μm) of generally insulating layers inclusive of a photoconductor layer and an undercoating layer. For example, Example 1 described hereinafter provides an electric field intensity of 500/13≈38.5 (volts/μm).

The γ value used in the present invention may preferably be 1.2 to 8. Below 1.2, the effect of providing a latent image with a higher resolution relative to an illumination beam spot is liable to be insufficient. In excess of 8, the gradation reproducibility is liable to be impaired since a change in exposure energy may be too sensitively reflected in the resultant latent image. It is further preferred to use a γ in the range of 1.5–5.

However, the above does not hold true when reproducing a purely binary image original including only characters and figures. In such a case, only a higher resolution is desired, so that it is preferred to provide a high electric field intensity so as to provide a larger induction energy and a large γ.

The photosensitive member used in the present invention may preferably show a change in γ of at least 0.01 and at most 0.5 and a change in induction energy of at least 0.1% and at most 20% of the saturation energy (sensitivity), respectively, per a change of 1 V/μm in electric field intensity. If the change in γ is below 0.01 or the change in induction energy is below 0.1%, it is liable to be difficult to effect sufficient characteristic control even if the charged potential is changed. On the other hand, if the change in γ exceeds 0.5 or the change in induction energy exceeds 20%, the characteristics are liable to be changed even on a slight fluctuation in charged potential, so that a uniform image formation becomes difficult. It is further preferred that the change in γ and the change in induction energy are in the range of 0.03–0.3 and 0.5%–5%, respectively, per a change of 1 V/μm in electric field intensity.

A photosensitive member suitably used in the present invention having a V-E characteristic providing an induction energy and a varying γ as shown in FIG. 1 may representatively be prepared by a photoconductive layer wherein a photoconductive pigment is dispersed in an insulting resin. The mechanism for such a pigment dispersion-type photosensitive member develops the electric field intensity-dependence of the induction energy and γ, may be considered as follows. Such a photoconductive pigment generates carriers including electrons and holes in separation when it is photoilluminated under application of a voltage. If the two types of carriers generated in this manner both have a sufficient mobility, they are liable to be re-combined with holes or electrons caused by charging to cause a change in internal electric field, so that no induction occurs. Further, because of the recombination of the carriers, the accumulation of carriers required for the induction phenomenon is not effected.

Therefore, in the present invention, it is preferred to use a photoconductive layer wherein one type of carrier (preferential or majority carrier) has a selectively large mobility and the mobility of the other-type of carrier (minority carrier) is substantially suppressed by entrapment. Accordingly, except for the case of using a photoconductive material inherently having such a selective carrier mobility characteristic, it is preferred to dope a pigment with a compound having a different ionization potential or disperse such a compound to be present in the vicinity of the pigment particles so as to trap one of the electrons or holes and prevent the recombination. Further, before the doping, it is preferred to purify the pigment so as to be closer to an intrinsic semiconductor. Furthermore, the pigment particles may preferably be present not in a perfect isolation state but in a moderate dispersion state such that the pigment particles retain a continuously agglomerated state to some extent. In such a dispersion state of pigment particles, an untrapped type of carrier moves along with such continuous or chain-like pigment particles under an electric field caused by charging to stop at a terminal of pigment chain. As there is some distance between the chain terminal particle and a neighboring chain of particles, the carrier accumulates without movement, thus showing no substantial photosensitivity (until it receives a substantial energy of illumination light). This phenomenon is called "induction". More specifically, a photoconductive pigment preferably used in the present invention is required to show a characteristic such that it promotes the movement of a preferentially movable carrier (preferential carrier) between electron and holes and traps the other type of carrier. Accordingly, in the case of copper phthalocyanine, for example, it is preferred to use a high purity of the pigment so as to promote the movement of the hole as the preferential carrier and dope the pigment with an electron-capturing compound to trap the electron.

If the carrier is accumulated and an internal electric field dominates over the electric field caused by the charging, a portion of the carrier migrates along the chain of pigment particles to lower the electric field by the charging. If the electric field by the charging is lowered, the accumulated carrier is allowed to move more easily. Because of such successive movement or migration of the carrier, a substantial sensitivity is provided. Further, a similar sensitivity is provided by movement of the carrier from a pigment particle chain terminal to another pigment particle chain due to a tunnel effect.

In this instance, there may be established the following relationship among the charged voltage, induction energy and $\gamma$. If the charged voltage is increased, the electric field intensity is increased, and the carrier movement due to the tunnel effect becomes predominant, whereby the induction energy is increased. If the carrier movement due to the tunnel effect is once started in this state, the electric field is abruptly lowered, whereby the remaining carriers are allowed to move and cause successive movement, thus resulting in a large $\gamma$. On the other hand, in case where the charged voltage is low, the electric field intensity is correspondingly low and the amount of carrier required to dominate the electric field intensity is decreased, thus resulting in a smaller induction energy. However, under a low electric field intensity, the tunnel effect tends to occur less, so that the carrier movement is principally caused by the accumulation of carrier in an amount sufficient to provide an internal electric field dominating the electric field intensity caused by the charging. In this case, however, only a small amount of carrier thermally exceeding the potential difference is generated, so that the resultant potential decrease is slow, thus providing a smaller $\gamma$.

Because of the above-mentioned mechanism, the electrophotographic photosensitive member used in the present invention is assumed to provide a larger induction energy and a larger $\gamma$ under a larger electric field intensity (in terms of an absolute value) caused by the charged voltage. As a result, in the present invention using such a photosensitive member, it becomes possible to provide both a latent image preferentially pursuing a high resolution based on a large induction energy and a large $\gamma$ and a latent image pursuing a high resolution and a good gradation in a good balance by controlling at least the electric field intensity and optionally further controlling the exposure energy.

FIG. 2 is a diagram for illustrating how a latent image of a higher resolution can be formed on a photosensitive member satisfying the above-mentioned V-E characteristics of the present invention by illumination with a spot beam having an intensity or exposure energy distribution. In order to provide a higher-resolution latent image, it is preferred to provide an induction energy which is at least 10% of the peak energy of the illumination spot beam. The induction energy should be below 80% of the peak energy of the illumination beam, otherwise the latent image formation becomes unstable such that a latent image is formed or not formed depending on a slight change in exposure energy. Further, in order to realize a good gradation characteristic, it is desirable to set a saturation sensitivity or energy in the range of 80–120% of the peak energy of the illumination beam.

The electrophotographic photosensitive member used in the present invention may be prepared by forming at least a photoconductive layer on an electroconductive support.

The electroconductive support may be composed of a material which per se has an electroconductivity, e.g., a metal, such as aluminum, aluminum alloy, copper, zinc, stainless steel, chromium, titanium, nickel, magnesium, indium, gold, platinum, silver, or iron. Alternatively, the electroconductive support may comprise a plastic material coated, e.g., with a vapor-deposited film of aluminum, indium oxide, tin oxide or gold, or a coating layer of electroconductive particles together with an appropriate binder on a support of a metal or plastic; or a plastic material or paper in mixture with electroconductive particles.

In the photosensitive member used in the present invention, it is also possible to dispose an undercoating layer having an injection barrier function and an adhesive function. Such an undercoating layer may be formed of, e.g., casein, polyvinyl alcohol, nitrocellulose, stylene-acrylic acid copolymer, polyvinyl butyral, phenolic resin, polyamide, polyurethane or gelatin. The undercoating layer may preferably have a thickness of 0.1–10 μm, particularly 0.3–3 μm.

The photoconductive layer, when incorporated in the photosensitive member, is required to show V (potential)-E (exposure energy) characteristics including an induction energy and a $\gamma$ respectively varying depending on an electric field intensity. So far as this condition is satisfied, the photosensitive layer may have a function-separation type structure including a charge generation layer comprising at least a charge generation substance and a charge generation substance and a charge transport layer comprising at least a charge transporting substance, or a single layer structure for performing the charge generation and charge transporting functions in a single photoconductor layer. The photoconductive layer may have an overall thickness in the range of 10–30 μm.

Examples of the charge generation substance may include: selenium-tellurium, pyryllium dyes, thiopyryllium dyes, phthalocyanine pigments, anthoanthrone pigments, dibenzpyrenequinone pigments, pyranthrone pigments, trisazo pigments, disazo pigments, azo pigments, indigo pigments, quinacridone pigments and cyanine pigments.

Examples of the charge transporting substance may include: polymeric compounds having a heterocyclic ring or a condensed polycyclic aromatic structure, such as poly-N-vinylcarbozole and polystyrylanthracene; heterocyclic compounds, such as pyrazoline, imidazole, oxazole, oxadiazole, triazole and carbazole; triarylalkane derivatives, such as triphenylmethane; triarylamine derivatives, such as triphenylamine; and low-molecular weight compounds, such as phenylenediamine derivatives, N-phenylcarbazole derivatives, stilbene derivatives and hydrazone derivatives.

The above-mentioned charge-generation substance and charge-transporting substance may be dispersed or dissolved, as desired, in a binder polymer. Examples of the binder polymer may include; polymers or copolymers of vinyl compounds, such as styrene, vinyl acetate, vinyl chloride, acrylates, methacrylates, vinylidene fluoride and trifluoroethylene, polyvinyl alcohol, polyvinyl acetal, polycarbonate, polyester, potysulfone, polyphenylene oxide, polyurethane, cellulosic resin, phenolic resin, melamine resin, silicone resin and epoxy resin.

Among the photoconductive materials inclusive of the charge generation substances, it is particularly preferred to use a p-type semiconductor using holes as a preferential carrier and doped with an electron-capturing compound, or an n-type semiconductor using electrons as a preferential carrier and doped with a hole-capturing compound. Examples of particularly preferred p-type semiconductors may include phthalocyanine compounds, inclusive of copper phthalocyanine, titanyl phthalocyanine, and hydroxygallium phthalocyanine, and examples of the doping electron-capturing compound may include nitrates and halogenides of the above-mentioned phtharocyanine compounds. Further, examples of particularly preferred n-type semiconductors may include disazo compounds, triazo compounds, zinc oxide and CdS, and examples of the doping hole-capturing compounds may include triphenylamine compounds.

In addition to the above-mentioned compounds, the photoconductive or photosensitive layer can contain some additives for improving the mechanical properties or durability or other purposes. Examples of such additives may include; antioxidant, ultraviolet absorber, stabilizer, crosslinking agent, lubricant and electroconductivity controller.

Figure 3:
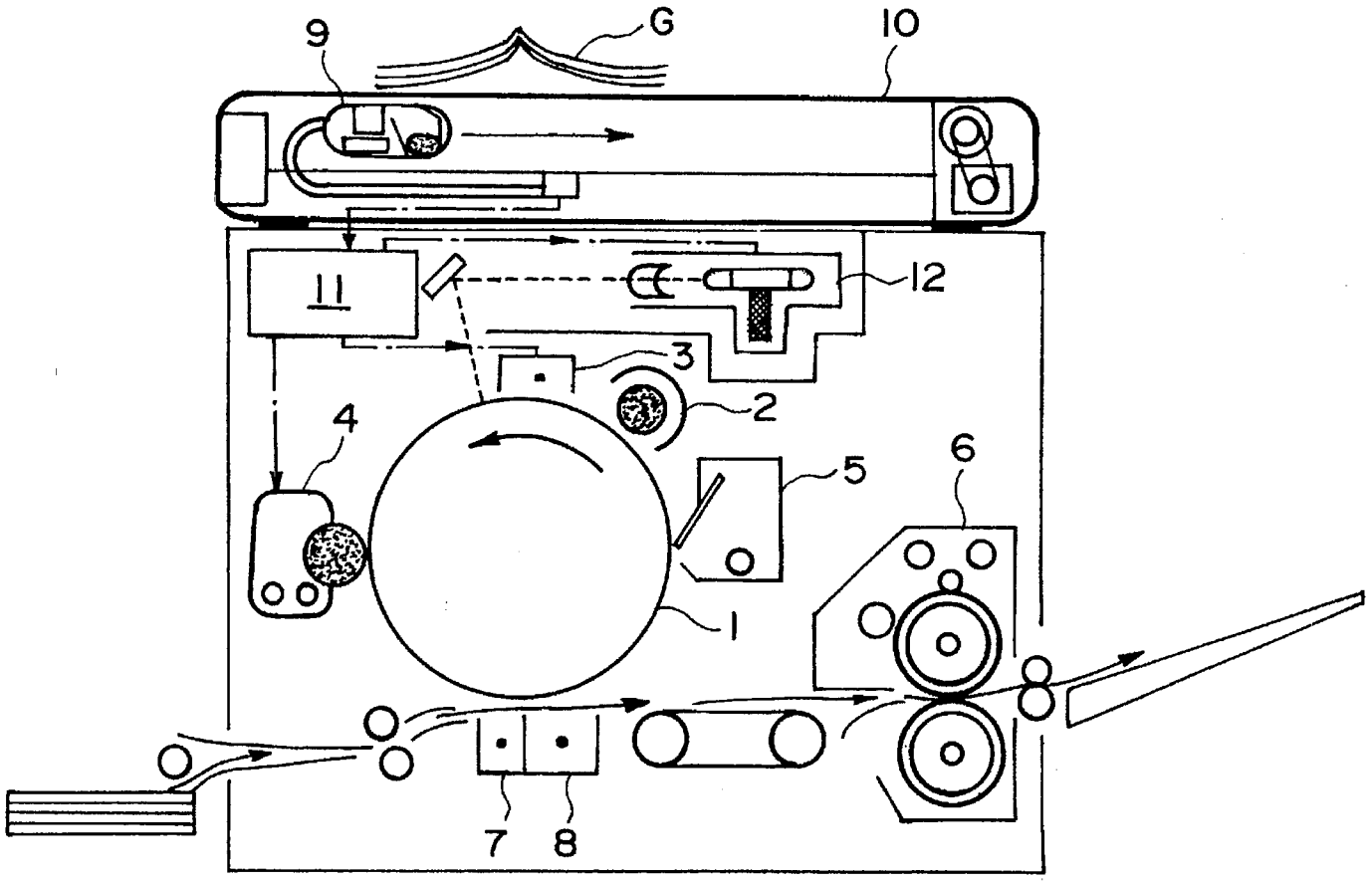
FIG. 3 is a schematic illustration of an embodiment of the electrophotographic apparatus according to the invention.

FIG. 3 illustrates an embodiment of the image forming apparatus according to the present invention.

Referring to FIG. 3, the image forming system according to the present invention may be operated as follows. First of all, an original G is set with its face to be reproduced directed downward onto an original table 10. Then, a copy button is pushed to start an copying operation. A unit 9 integrally incorporating an original illumination lamp, a short-focus lens array and a CCD sensor is moved to scanningly illuminate the original, whereby the illumination scanning beam carrying photosignals is focused by the short-focus lens array and enters the CCD sensor. The CCD sensor is composed of a light-receiving section, a transfer section and an output section. At the CCD light-receiving section, the photosignals are converted into electric signals (charge signals), which are transferred by the transfer section successively to the output section in synchronism with clock pulses. At the output section, the charge signals are converted into voltage signals, which are amplified and converted into a low impedance form to be outputted. The thus formed analog signals are converted into digital signals, which are optimized by a controller 11 with respect to resolution and gradation depending on the image characteristics of the original G and sent to a printer section including a charging means 3, a developing means 4 and a laser scanning unit 12, which are also controlled by the controller 11. Alternatively, in case where image data is supplied directly from a computer which can be used in place of the controller 11, the image data is processed and converted by the computer to be supplied to the printer section while selecting mode of reproducing resolution and gradation so as to provide desirable images. In the printer section, image formation is performed in the following manner based on the above-supplied image signals.

A photosensitive member 1 according to the present invention in the form of a drum is rotatively driven at a prescribed peripheral speed about a control shaft and, during the rotation thereof, is charged by a charging means 3, e.g., uniformly to a prescribed voltage of a positive polarity or a negative polarity. The charged (applied) voltage on the photosensitive member 1 is controlled depending on image data such as the nature of the original image to be reproduced whether it is principally a binary image comprising characters, etc., or a gradational image, such as a photographic image, obtained by characterization of the original image during the above-mentioned conversion of the analog signals from the CCD light-receiving section into digital signals.

More specifically, in case of desiring a higher resolution, the charging means 3 is controlled to provide a higher charged voltage so as to utilize a larger γ and a larger induction energy. In case of desiring a richer gradation, the charging means 3 is controlled to provide a lower charged voltage so as to utilize a smaller γ and a smaller induction energy. For example, if the image to be outputted is all composed of binary images, a high voltage is applied depending on a required resolution thereof. If the image is principally composed of gradational images, a lower voltage is applied. The charging means 3 is controlled, for example, in this manner. On the other hand, the image to be outputted is composed of binary images and gradational images in mixture, the voltage is controlled so as to optimize the induction energy and γ of the photosensitive member depending on the characteristics of the mixture image. in the present invention, it is also possible to output images which has been modified in various manners as desired from an original image by setting applied (charged) voltage to the photosensitive member in various manners based on the original image data.

The applied voltage may be uniformly set for each original (sheet) based on the resolution and gradation thereof. Alternatively, it is also possible to set different applied voltages for regions having different image characteristics of an original, e.g., in case where an original has substantially large regions clearly demarcated from each other because of image characteristics, such as a region composed primarily of binary images and a region primarily composed of gradational images. Further, even in case where binary images and gradation images are in a higher degree of mixture, it is also possible to change the applied voltage corresponding to the image characteristic change or to provide an imagewise varying applied voltage.

In the present invention, the charging means 3 may comprise a corona charger, a roller charger, a brush charger, a magnetic brush charger or a blade charger. Further, in order to provide an imagewise varying voltage or regionally different applied voltages to considerably small regions, it is possible to use, e.g., an ionic flow charger as disclosed in U.S. Pat. No. 4,155,093.

Then, the thus-charged surface of the photosensitive member 1 is scanned with laser beam issued from a solid laser device turned ON and OFF depending on image signals and directed by a polygonal mirror rotating at a high speed in the laser scanning unit 12 to successively form latent images on the photosensitive member 1 corresponding to the original image.

Figure 4:
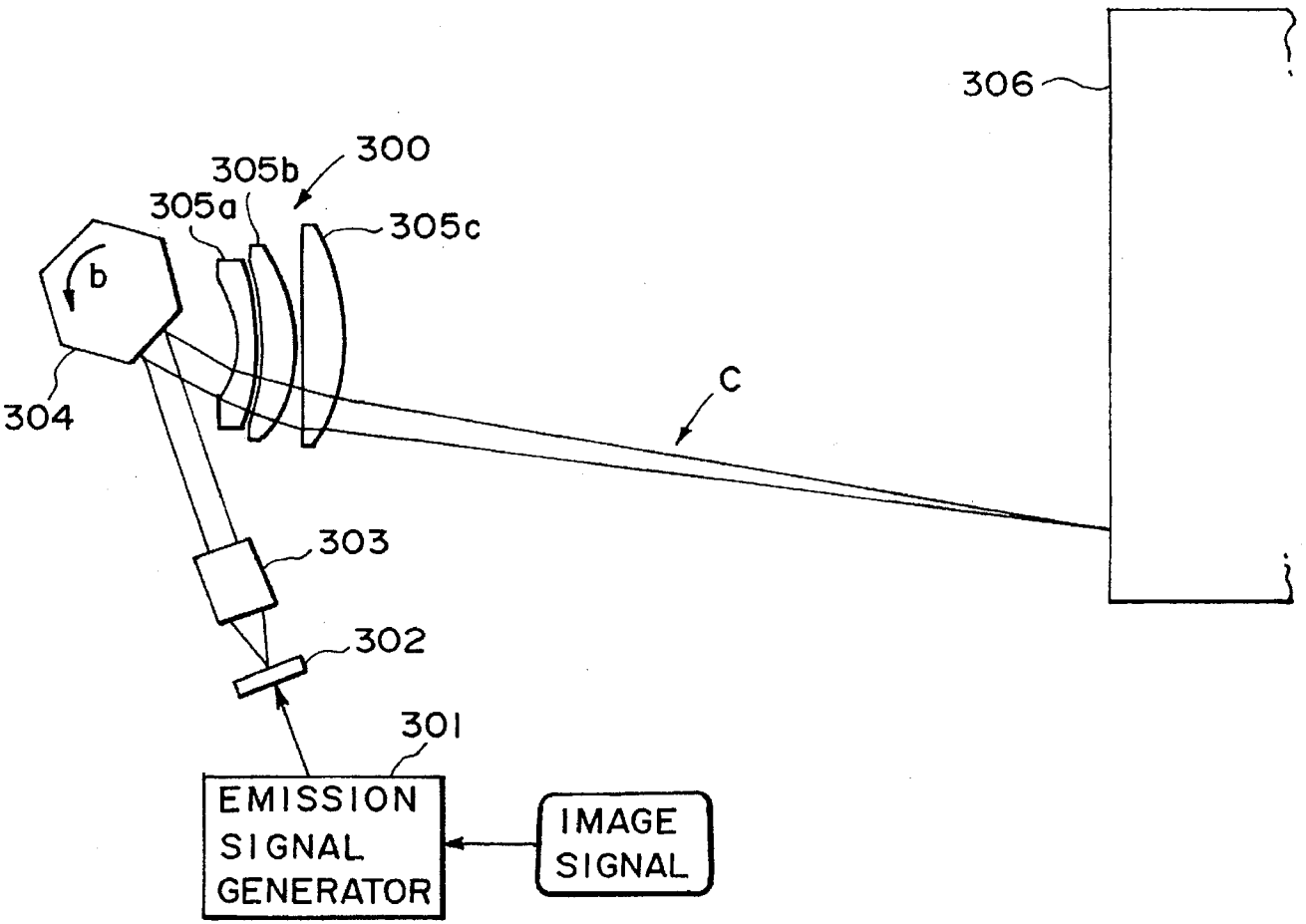
FIG. 4 is an enlarged schematic illustration of a laser beam scanning unit used in an embodiment of the electrophotographic apparatus according to the invention.

FIG. 4 is an enlarged schematic illustration of a laser scanning unit 300 (corresponding to the unit 12 in FIG. 3) for scanning a laser beam in the above-described image forming apparatus shown in FIG. 3. For scanning of the laser beam by the laser scanning unit 300, a laser beam is emitted from a solid laser device 302 excited by emission signals supplied from an emission signal generator 301 based on image signals is converted by a collimator lens system 303, which are directed into an arrow C direction by a rotatory polygonal mirror 304 rotating in the direction of an arrow b and focused by f-θlenses 305*a*, 305*b* and 305*c* into a spot onto an illuminated surface 306 on the photosensitive drum (1 in FIG. 3). By the laser beam scanning, the illuminated surface 306 is provided with an exposure energy distribution for one line of scanning image, and the illuminated surface 306 is scrolled by a prescribed width in a direction perpendicular to the scanning direction to form an exposure energy distribution on the illuminated surface 306 corresponding to given image signals.

Figure 5:
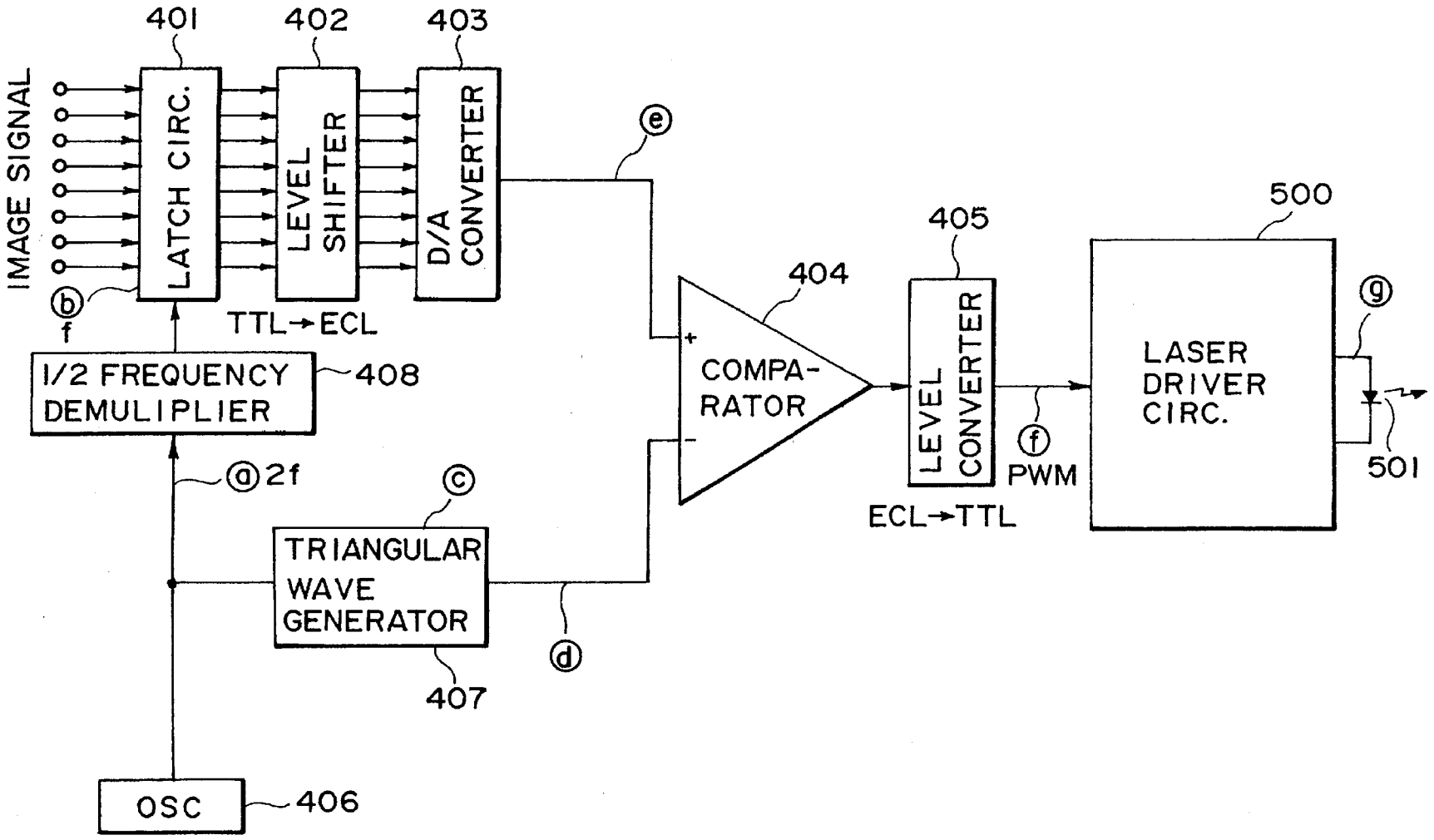
FIG. 5 is a block diagram of a pulse width modulation (PWM) circuit for laser beam control applicable to the invention.
Figure 6:
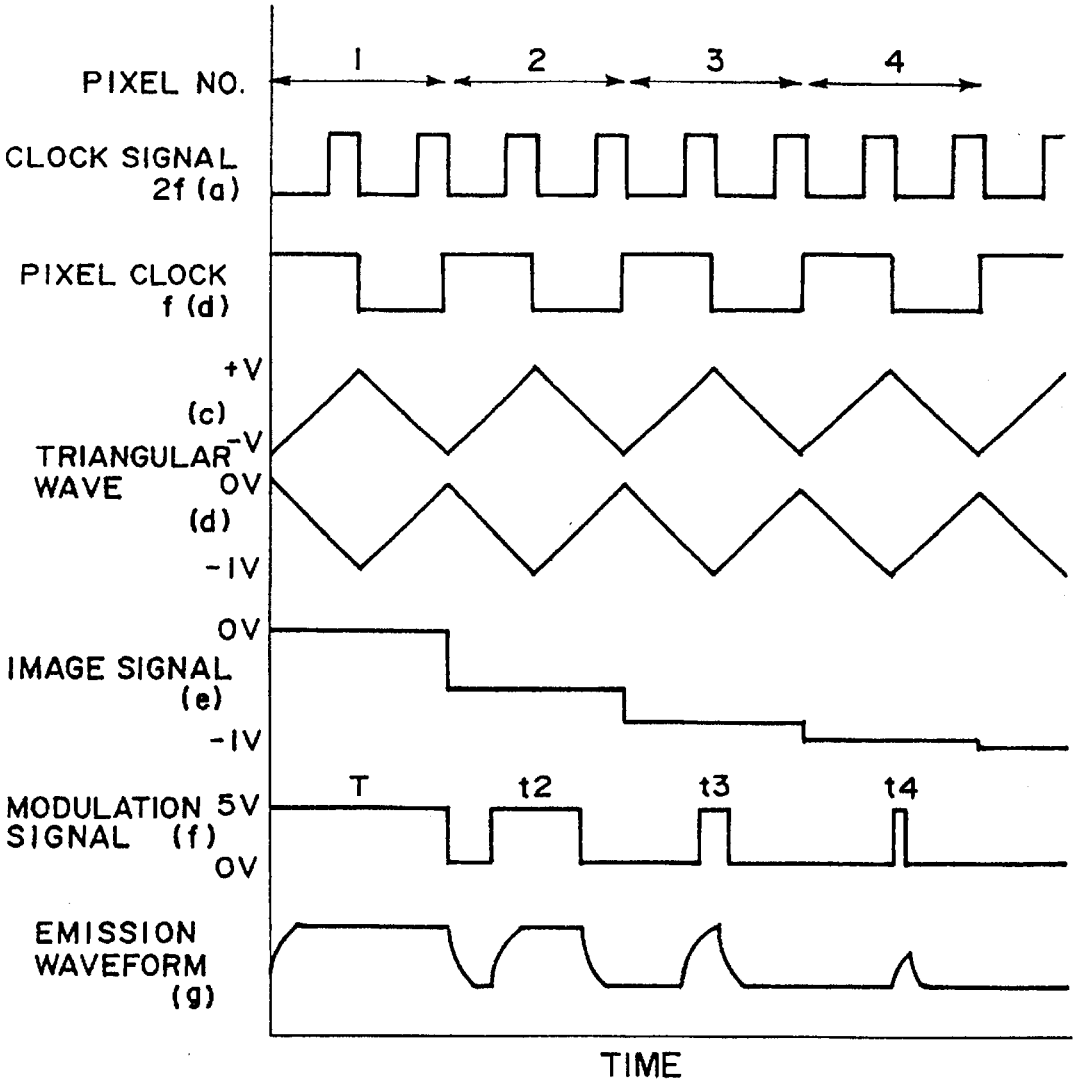
FIG. 6 is a waveform time chart for illustrating the operation of a PWM circuit for laser beam control.
Figure 7:
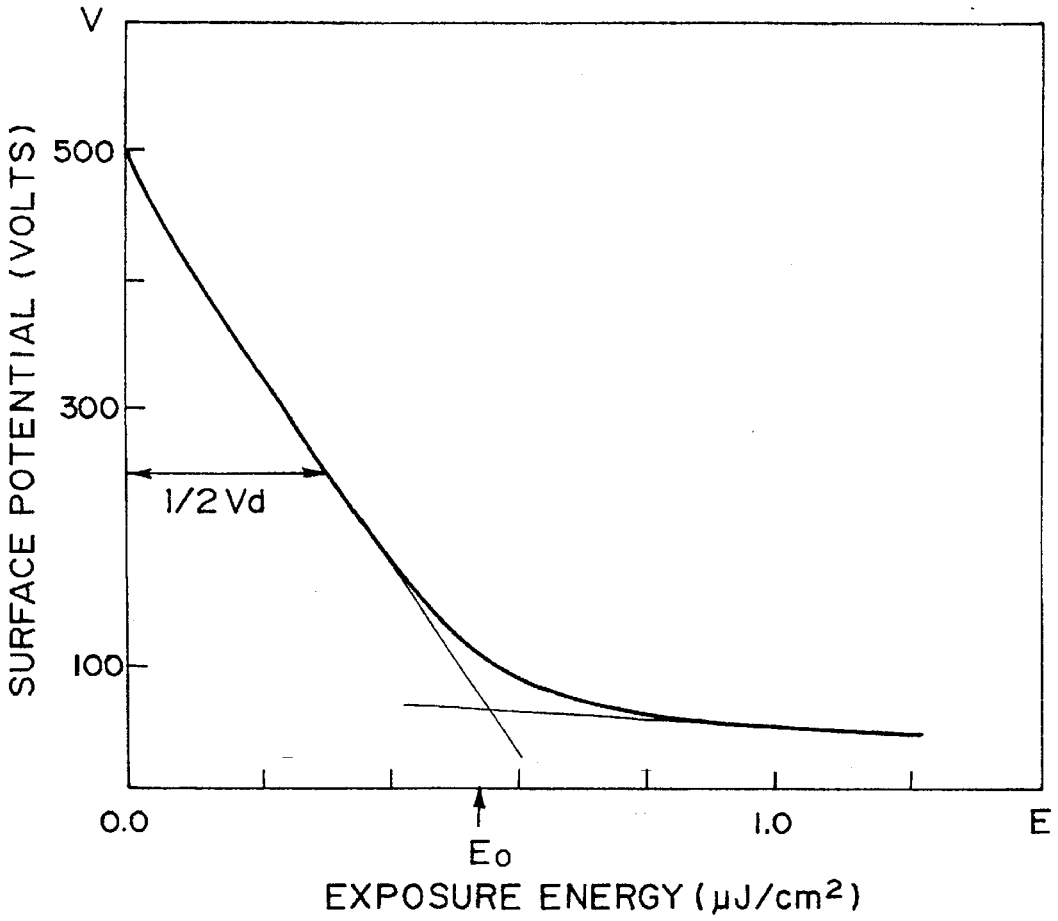
FIG. 7 is a graph showing a V-E curve of a convention electrophotographic photosensitive member.

In this embodiment, a multi-value recording is also performed according to an areal gradation, mode based on a PWM (pulse width modulation) scheme, which will be described with reference to FIGS. 5 and 6, of which FIG. 5 is a block diagram of an embodiment of a PWM circuit and FIG. 6 is a time chart for illustrating the operation of the circuit.

Referring to FIG. 5, the PWM circuit includes a TTL latch circuit 401 for latching 8 bit-digital signals, a high speed level shifter for converting TTL logic levels into ECL logic levels, a high-speed D/A converter 403 for converting the ECL logic levels into analog signals. The PWM circuit further includes an ECL comparator for emitting PWM signals, a level converter 405 for converting ECL logic levels into TTL logic levels, a clock signal oscillator 406 for generating clock signals 2*f*, a triangular wave generator 407 for generating substantially ideal triangular wave signals synchronized with clock signals 2*f*, and a ½ frequency demultiplier 408 for subjecting the clock signals 2*f* to ½ frequency demultiplication to form image clock signals f. That is, the clock signals 2*f* have a frequency which is two times the frequency of the image clock signals f. For a high-speed operation of the circuit, some ECL logic circuits may be placed at desired parts.

The operation of the PWM circuit will now be described with reference to the time chart of FIG. 6. Referring to FIG. 6, at (a) are shown clock signals 2*f* and at (b) are shown clock signals f which are related with image signals as shown at (e). Also in the triangular wave generator 407, the clock signals 2*f* are ½ frequency-demultiplied to generate triangular signals (c), which are converted into triangular wave signals (d) by conversion into the ECL level.

On the other hand, image signals (e) vary at 256 levels ranging from OOh (white) to FFh (black). At (e) in FIG. 6, some image signals are shown by ECL voltage levels after the D/A conversion. For example a black level of FFh is allotted to a first pixel; a halftone level of 80*h*, to a second pixel; a halftone level of 40*h*, to a third pixel; and a halftone level of 20*h* to a fourth pixel. The comparator 404 compares the triangular wave signals (d) and the image signals (e) to generate PWM signals having pulse widths T, $t_2$, $t_3$, $t_4$, etc., corresponding to image densities to be formed. The PWM signals are then converted into PWM signals (f) by conversion into a TTL level of 0 volt or 5 volts and then inputted to a laser drive circuit 500. Corresponding to the PWM signals thus obtained, the exposure period for each pixel is controlled to provide 256 gradation levels at the maximum for each pixel.

In this embodiment, the gradation control by the PWM scheme is adopted, but it is also possible to adopt an areal gradation scheme based on the dither method, a laser beam intensity modulation scheme or a combination of these schemes.

An electrostatic latent image thus formed on the photosensitive member 1 is developed by a developing apparatus 4 in which a developing bias level applied to a developing sleeve may be controlled corresponding to the charged voltage level on the photosensitive member, to form a toner image thereon, which is then electrostatically transferred by a transfer charger 7 to a transfer-receiving material. The transfer-receiving material carrying the toner image is electrostatically separated from the photosensitive member 1 by a separation charger 8 and conveyed to a fixing device, where the toner image is thermally fixed onto the transfer-receiving material to form a copy image thereon, followed by discharge.

On the other hand, the surface of the photosensitive member 1 after the toner image transfer is subjected to removal of attached soiling materials, such as residual toner thereon by a cleaner 5, further electrically cleaned by a pre-exposure means 2 and re-used for repetitive image formation.

In specific Examples described below, image formation was performed by using an image forming apparatus substantially as described above, which included a semiconductor laser (12, 302) of 680 nm and 35 mW issuing a laser beam providing a spot diameter ($1/e^2$) of 60 μm on the photosensitive member 1. Gradation recording was performed based on the PWM scheme, and outputted images were used for measuring a minimum resolution spot diameter and evaluation of gradation density reproducibility with eyes.

EXAMPLE 1

1 Wt. part of treated α-type Cu-phthalocyanine pigment obtained by doping Cu-phthalocyanine with 3 wt. % of tetranitro-Cu-phthalocyanine and 4 wt. parts (as solid matter) of polyester-melamine mixture thermosetting resin ("ALMATEX P645"/"UVAN 20S", mfd. by Mitsui Toatsu Kagaku K.K.) were added to 20 wt. parts of cyclohexanone, followed by dispersion with a paint shaker. The thus-formed dispersion liquid was applied by dipping onto a 80 mm-dia.

cut-finished aluminum cylinder and dried at 150° C. for 1 hour to form an electrophotographic photosensitive member having a 13 μm-thick photoconductive layer, which provided V-E curves shown in FIG. 1. For a charged voltage (Vd) of 500 volts (electric field intensity=38.5 V/μm), the induction energy was 0.9 μJ/cm$^2$ and γ was 2.8. When the photosensitive member was illuminated with a laser spot beam at an exposure energy of 0.8 μJ/cm$^2$ in the spot diameter (1/e$^2$) of 60 μm, and developed with a two component-type developer including a non-magnetic black toner having an average diameter of 8 μm under application of a bias voltage Vdc of 450 volts, the minimum resolution (Example 1) diameter was ca. 25 μm and the gradation reproducibility by the PWM scheme was good. The results are summarized in Table 1 appearing hereinafter.

EXAMPLES 2–3 AND COMPARATIVE EXAMPLES 1–2

The above-described procedure of Example 1 was repeated by charging the charged potential levels (Vd) on the photosensitive member to 300 volts, 200 volts, 700 volts and 100 volts, respectively, while satisfying a relationship of |Vd-Vdc|=50 volts and controlling the laser beam intensity be equal to the saturation sensitivities at the charged potential levels, similarly as in all Examples and Comparative Examples herein. The results are inclusively shown in Table 1.

COMPARATIVE 3

An aluminum cylinder of 80 mm in diameter and 360 mm in length as an electroconductive substrate was coated by dipping with a 5% methanol solution of a polyamide ("AMILAN CM-8000" mfd. by Toray K.K.), followed by drying, to form a 1 μm-thick undercoating layer.

Separately, 10 wt. parts of titanylphthalocyanine pigment, 10 wt. parts of polyvinyl acetal resin ("S-LEC BX-1", mfd. by Sekisui Kagaku K.K.) and 100 wt. parts of cyclohexanone were subjected to dispersion for 3 hours in a sand mill containing 1 mm-dia. glass beads. The resultant dispersion was diluted with 100 wt. parts of ethyl acetate, and the mixture was applied onto the undercoating layer and dried at 100° C. for 10 min. to form a 0.15 μm-thick charge generation layer.

The charge generation layer was further coated with a solution of 90 wt. parts of 4-N,N-diethylaminobenzaldehydediphenylhydrazone an 100 wt. parts of polycarbonate resin ("NOVAREX", mfd. by Mitsubishi Kasei Kogyo K.K.) dissolved in chlorobenzene and dried at 120° C. for 1 hour to form a 22 μm-thick charge transport layer, thereby providing an electrophotographic photosensitive member of function-separation type.

Photosensitive member was formed to provide a V-E curve at a charged voltage of −700 volts showing an induction energy of 0 and thus a γ of 1.0.

The photosensitive member was evaluated at a charged voltage of −700 volts with respect to image forming performances in the same manner as in Example 1, whereby a minimum resolution diameter was ca. 45 μm and the gradation reproducibility was inferior at highlight portions.

COMPARATIVE EXAMPLE 4

The photosensitive member of Comparative Example 3 was evaluated at a charged voltage of −500 volts with respect to the V-E curve and the image forming performances. The results are shown in Table 1.

TABLE 1

| Example or Comp. Example | Charged potential (Electric field intensity) | Induction energy (μJ/cm$^2$) | γ | Minimum solution dia. (μm) | Gradation reproducibility |
|---|---|---|---|---|---|
| Example 1 | 500 V (38.5 V/μm) | 0.9 | 2.8 | ca. 25 | Good |
| Example 2 | 300 V (23 V/μm) | 0.6 | 2 | ca. 25 | Good |
| Example 3 | 200 V (15 V/μm) | 0.36 | 1.6 | ca. 25 | Good |
| Comp. Example 1 | 700 V (54 V/μm) | 1.5 | 10 | ca. 20 | Noticeable irregularity |
| Comp. Example 2 | 100 V (8 V/μm) | 0.04 | 1.1 | ca. 40 | Poor at high-light portion |
| Comp. Example 3 | −700 V (−30 V/μm) | 0 | 1.0 | ca. 45 | Poor at high-light portion |
| Comp. Example 4 | −500 V (−22 V/μm) | 0 | 1.0 | ca. 50 | Poor at high-light portion |

What is claimed is:

1. An electrophotographic apparatus, comprising: an electrophotographic photosensitive member, charging means for charging the photosensitive member to a potential, and exposure means for illuminating the charged photosensitive member with a light beam to form an electrostatic image thereon;

wherein said electrophotographic photosensitive member has a potential-exposure energy characteristic providing an induction energy and a gamma value varying depending on an electric field intensity induced by the charged potential, and said apparatus further includes control means for controlling the charged potential on the photosensitive member corresponding to resolution and gradation data of an original.

2. An apparatus according to claim 1, wherein gamma value is in the range of 1.2–8.

3. An apparatus according to claim 2, wherein γ is in the range of 1.5–5.

4. An apparatus according to claim 1, wherein γ changes at a rate of 0.01–0.5 for a change of 1 V/μm in electric field intensity.

5. An apparatus according to claim 4, wherein γ changes at a rate of 0.03–0.3 for a change of 1 V/μm in electric field intensity.

6. An apparatus according to claim 1, wherein γ increases as the electric field intensity in terms of an absolute value increases.

7. An apparatus according to claim 1, wherein the electric field intensity in terms of an absolute value is 10–50 volts/μm.

8. An apparatus according to claim 7, wherein the electric field intensity in terms of an absolute value is 15–38 volts/μm.

9. An apparatus according to claim 1, wherein said induction energy is 10–80% of a peak intensity of the light beam.

10. An apparatus according to claim 1, wherein said induction energy also varies depending on the electric field intensity.

11. An apparatus according to claim 10, wherein said induction energy varies at a rate of 0.1–20% of a saturation sensitivity of the photosensitive member for a change in electric field intensity of the photosensitive member for a change in electric field intensity of 1 volt/μm.

12. An apparatus according to claim 11 wherein said induction energy varies at a rate of 0.5–5% of a saturation sensitivity of the photosensitive member for a change in electric field intensity of the photosensitive member for a change in electric field intensity of 1 volt/μm.

13. An apparatus according to claim 10, wherein said induction energy increases as the electric field intensity in terms of an absolute value increases.

14. An apparatus according to claim 6 or 13, wherein the charged potential in terms of an absolute value is controlled to be increased corresponding to an increase in resolution.

15. An apparatus according to claim 6 or 13, wherein the charged potential in terms of an absolute value is controlled to be decreased corresponding to an increase in degree of gradation.

16. An apparatus according to claim 1, wherein said exposure means issues a pulsed light beam having a modulated pulse width.

17. An image forming method, comprising: a charging step of charging an electrophotographic photosensitive member to a charged potential, and an exposure step of illuminating the charged photosensitive member with a light beam to form an electrostatic image thereon; wherein said electrophotographic photosensitive member has a potential-exposure energy characteristic providing an induction energy and a gamma value varying depending on an electric field intensity inducted by the charged potential, and in the charging step, the charged potential on the photosensitive member is controlled corresponding to resolution and gradation data of an original.

18. A method according to claim 17, including the step of selecting a gamma value in the range of 1.2–8.

19. A method according to claim 17, including the step of selecting a gamma value in the range of 1.5–5.

20. A method according to claim 17, wherein γ changes at a rate of 0.01–0.5 for a change of 1 V/μm in electric field intensity.

21. A method according to claim 20, wherein γ changes at a rate of 0.03–0.3 for a change of 1 V/μm in electric field intensity.

22. A method according to claim 17, wherein γ increases as the electric field intensity in terms of an absolute value increases.

23. A method according to claim 17, including controlling the electric field intensity in terms of absolute value to 10–50 volts/μm.

24. A method according to claim 23, including controlling the electric field intensity in terms of absolute value to 15–38.

25. A method according to claim 17, including the step of controlling induction energy from 10–80% at a peak intensity of the light beam.

26. A method according to claim 17, wherein said induction energy also varies depending on the electric field intensity.

27. A method according to claim 26, wherein said induction energy varies at a rate of 0.1–20% of a saturation sensitivity of the photosensitive member for a change in electric field intensity of the photosensitive member for a change in electric field intensity of 1 volt/μm.

28. A method according to claim 27, wherein said induction energy varies at a rate of 0.5–5% of a saturation sensitivity of the photosensitive member for a change in electric field intensity of the photosensitive member for a change in electric field intensity of 1 volt/μm.

29. A method according to claim 26, wherein said induction energy increases as the electric field intensity in terms of an absolute value increases.

30. A method according to claim 22 or 29, wherein the charged potential in terms of an absolute value is controlled to be increased corresponding to an increase in resolution.

31. A method according to claim 22 or 29, wherein the charged potential in terms of an absolute value is controlled to be decreased corresponding to an increase in degree of gradation.

32. A method according to claim 17, wherein said exposure means issues a pulsed light beam having a modulated pulse width.

* * * * *